US007416447B1

(12) United States Patent
Chen

(10) Patent No.: US 7,416,447 B1
(45) Date of Patent: Aug. 26, 2008

(54) TERMINAL MODULE FOR FEMALE CONNECTOR

(75) Inventor: Ying-Chung Chen, Taipei Hsien (TW)

(73) Assignee: Chief Land Electronic Co., Ltd., Taipei Hsien (TW)

( * ) Notice: Subject to any disclaimer, the term of this patent is extended or adjusted under 35 U.S.C. 154(b) by 0 days.

(21) Appl. No.: 11/963,764

(22) Filed: Dec. 21, 2007

(51) Int. Cl.
*H01R 13/648* (2006.01)

(52) U.S. Cl. ..... 439/608; 439/701; 439/108

(58) Field of Classification Search ..... 439/95, 439/108, 608, 701
See application file for complete search history.

(56) References Cited

U.S. PATENT DOCUMENTS 6,431,914 B1 * 8/2002 Billman ..... 439/608
6,808,420 B2 * 10/2004 Whiteman et al. ..... 439/608
6,979,226 B2 * 12/2005 Otsu et al. ..... 439/608

* cited by examiner

*Primary Examiner*—Tho D Ta

(57) ABSTRACT

A terminal module for a female connector has a metal grounding member and an insulating terminal base to receive the grounding member. The grounding member includes an extension portion and a contact arm corresponding to the extension portion. The extension portion is extended from an edge of the grounding member and parallel to the edge of the grounding member. The contact arm is extended from a side surface of the grounding member and away from the extension portion. When a plurality of the terminals modules is fitted into a connector insulator of the female connector, the extension portions and the contact arms of the terminal modules are contacted with each other and are electrically connected in series.

3 Claims, 10 Drawing Sheets

TERMINAL MODULE FOR FEMALE CONNECTOR

BACKGROUND OF THE INVENTION

1. Field of the Invention

The present invention relates to a terminal module for a female connector, and in particular to a terminal module having a grounding member that can be connected with another grounding members in series.

2. The Prior Arts

Referring to FIGS. 1 and 2, a conventional connector includes a male conductor 14 and a female conductor. The female connector includes a connector insulator 10 and a plurality of terminal modules 12 inserted into the connector insulator 10. The connector insulator 10 has a plurality of L-shaped grounding terminal openings 10*a* and signal terminal openings 10*b* adjacent to the L-shaped grounding terminal openings 10*a*. The male connector 14 includes a plurality of L-shaped grounding terminal 14*a* corresponding to the grounding terminal openings 10*a* and a plurality of post-shaped signal terminals 14*b* corresponding to the signal terminal openings 10*b*. When the male connector 14 is engaged with the female connector, the grounding terminals 14*a* and the signal terminals 14*b* are inserted into the grounding terminal openings 10*a* and the signal terminal openings 10*b*, respectively. Therefore, the grounding terminals 14*a* and the signal terminals 14*b* are electrically connected with grounding pins 12*c* and signal pins 12*b* of the terminal modules 12, respectively. The terminal module 12 includes an elastic fixing portion 12*d* and the connector insulator 10 includes a plurality of fixing openings 10*c* corresponding to the elastic fixing portion 12*d*. When the terminal module 12 is fitted into the connector insulator 10, the elastic fixing portion 12*d* is engaged with the fixing opening 10*c*. Therefore, the terminal module 12 is securely connected with the connector insulator 10.

However, the elastic fixing portion 12*d* of the terminal module 12 is made of an insulating material. The elastic fixing portion 12*d* fractures easily especially when the terminal module 12 is fitted into the connector insulator 10. The terminal module 12 includes a metal grounding member 11. However, when the terminal modules 12 are fitted into the connector insulator 10, the grounding members 11 are not electrically connected. Therefore the grounding effect of the conventional terminal module can still be improved.

SUMMARY OF THE INVENTION

A primary objective of the present invention is to provide a terminal module for a female connector that is equipped with a grounding member. When the terminal modules are fitted into a connector insulator of the female connector, the grounding members of the terminal modules are contacted with each other and are electrically connected in series.

Another objective of the present invention is to provide a fixing portion of a terminal module that is not easy to fracture when the terminal module is fitted into a connector insulator of a female connector.

In order to achieve the objectives mentioned above, a terminal module according to the present invention includes a grounding member and a module base to receive the grounding member. The grounding member is substantially made of metal. The grounding member includes a main body, an extension portion extended from an edge of the main body and perpendicular to the main body, and a contact arm corresponding to the extension portion extended from the main body and away from the extension portion. When the terminal modules are fitted into the connector insulator, the extension portion of the terminal module is contacted with a contact arm of an adjacent terminal module. Therefore, the grounding members of the terminal modules are electrically connected in series. A fixing portion according to the present invention is extended fron the grounding member and made of metal. Thus the strength of the metal fixing portion is greater than that of a conventional fixing portion.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
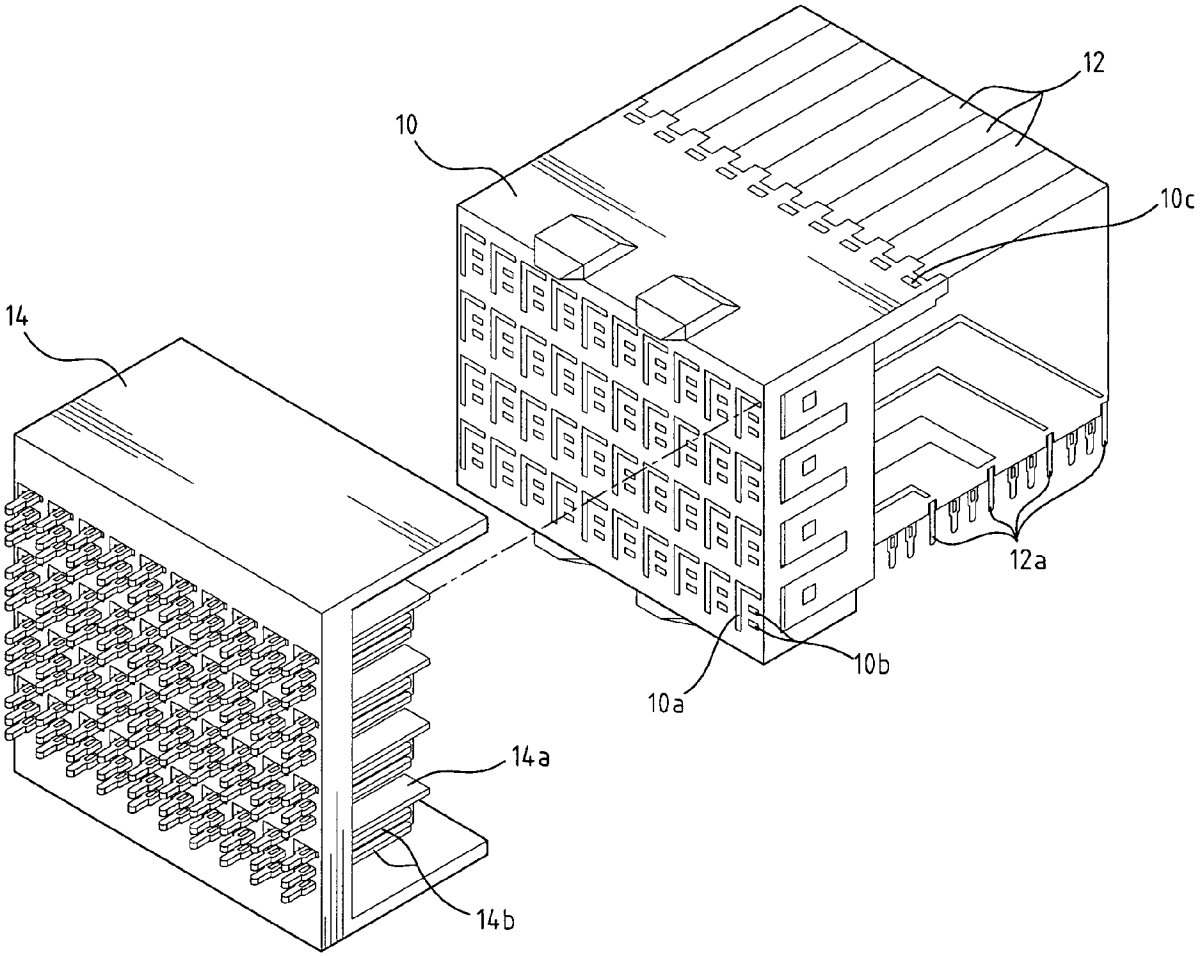
FIG. 1 ( Prior Art )
FIG. 1 is a perspective view showing a conventional electrical connector, which includes a male connector and a female connector.
Figure 2:
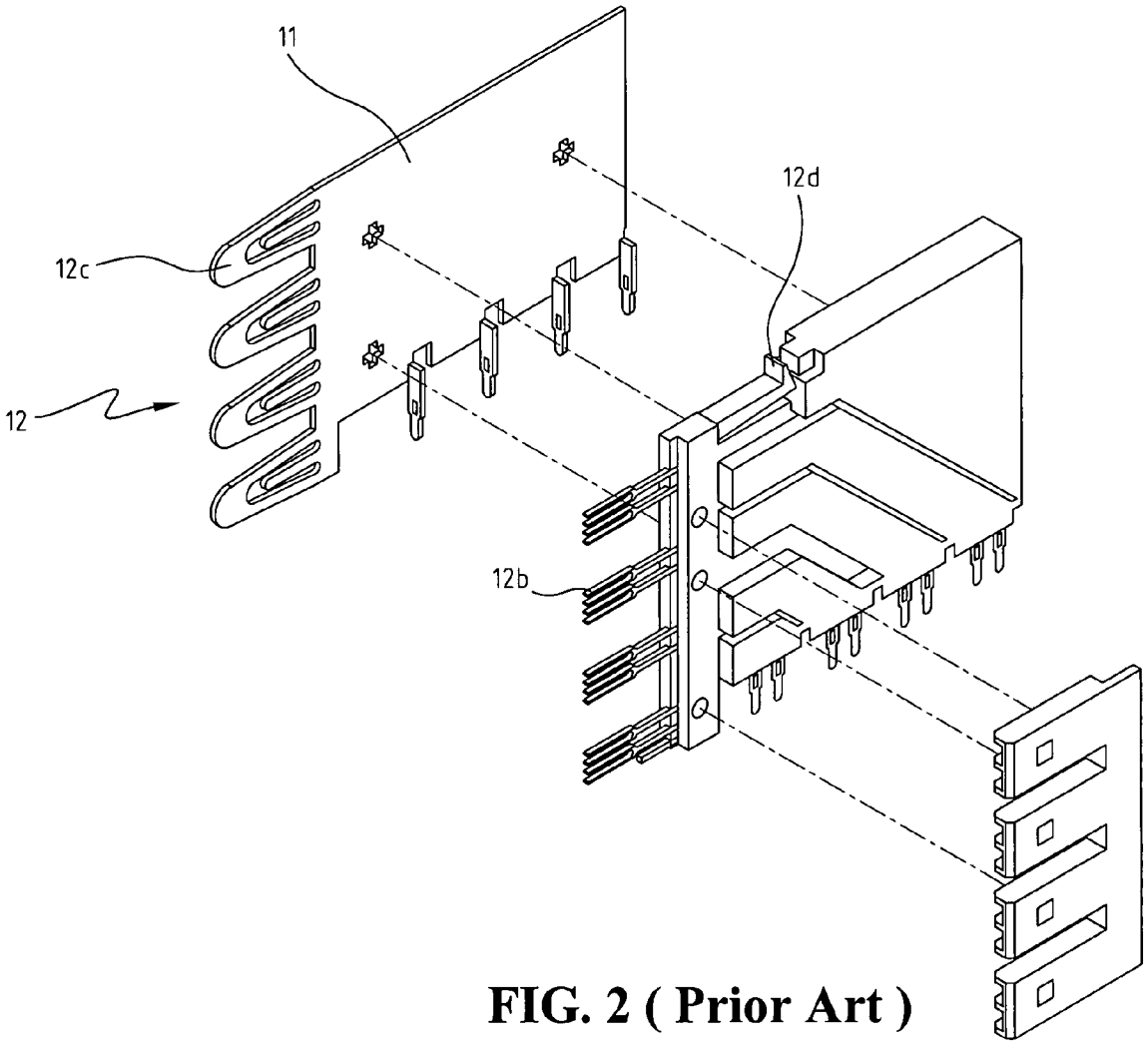
FIG. 2 ( Prior Art )
FIG. 2 is an explosive view showing a conventional terminal module of the female connector.

Referring to FIGS. 3A to 3E, a female connector includes a connector insulator 20 and a plurality of terminal modules 22 according to the present invention fitted into the connector insulator 20. Referring to FIG. 4, the terminal module 22 according to the present invention includes a grounding member 30 and a module base 32 to receive the grounding member 30.

Figure 3A:
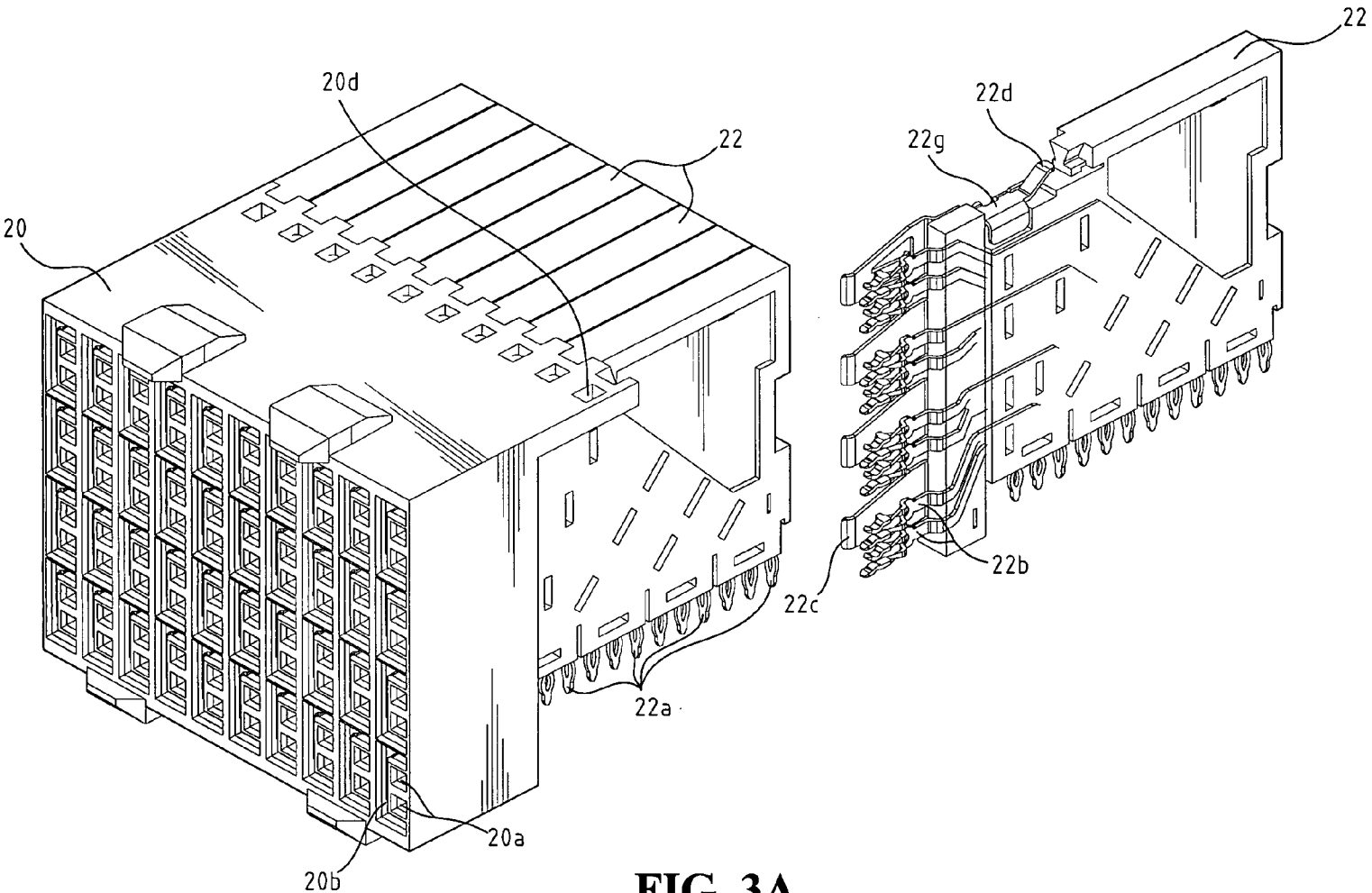
FIG. 3A is a perspective view showing a female connector including a connector insulator and a plurality of terminal modules according to the present invention, and one of the terminal modules is pulled out.
Figure 3B:
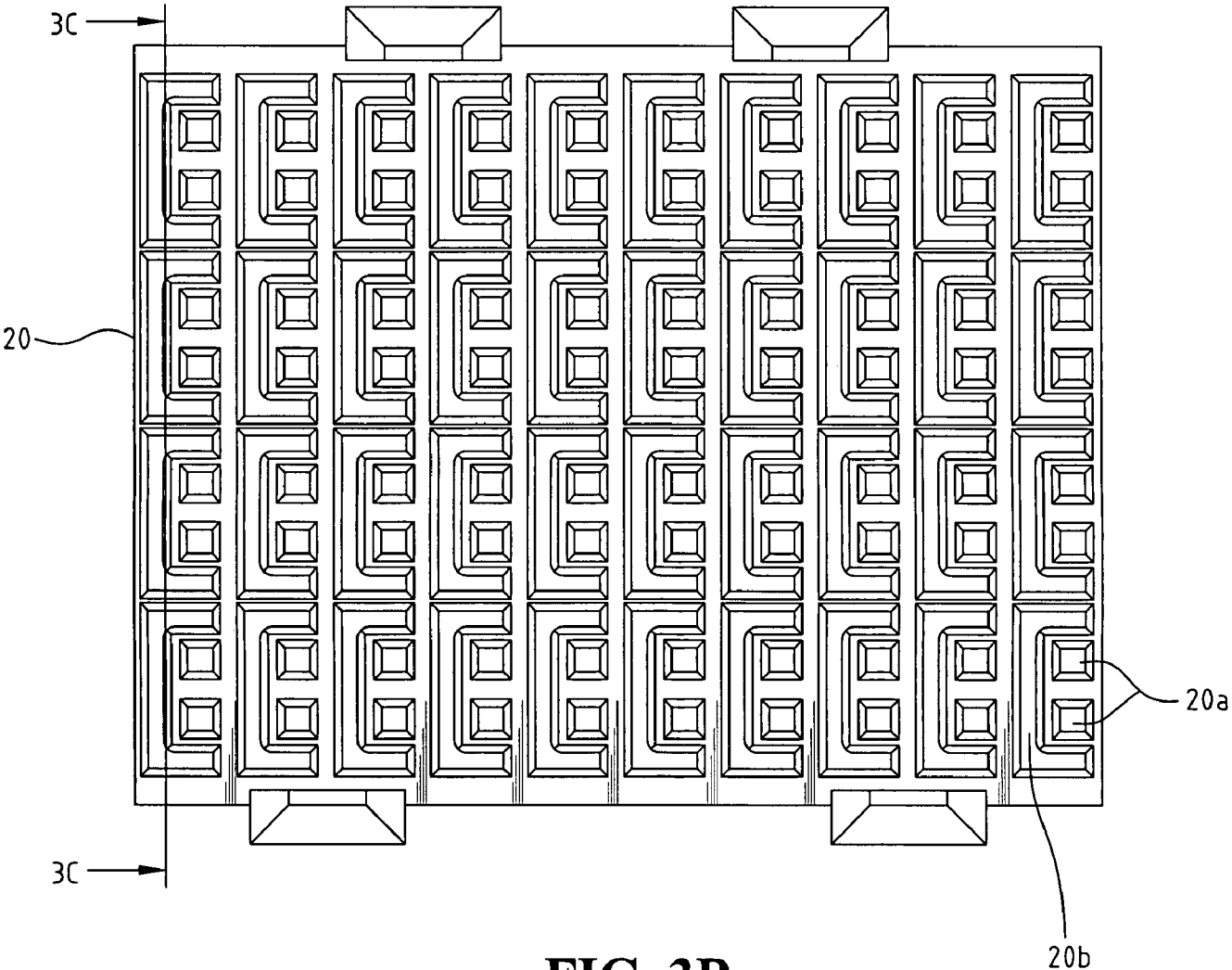
FIG. 3B is a front view showing the female connector of FIG. 3A.
Figure 3C:
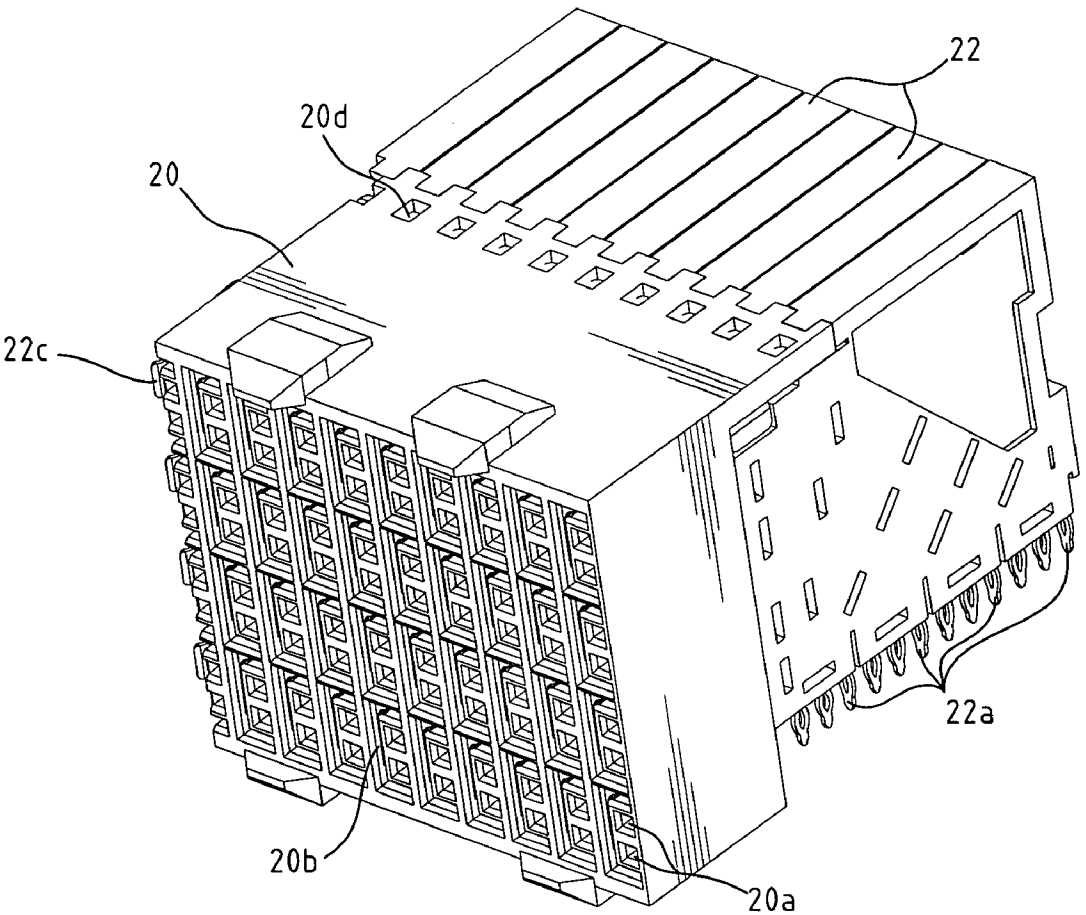
FIG. 3C is a perspective view showing the female connector of FIG. 3B after the female connector is cut off along Line 3C-3C.
Figure 3D:
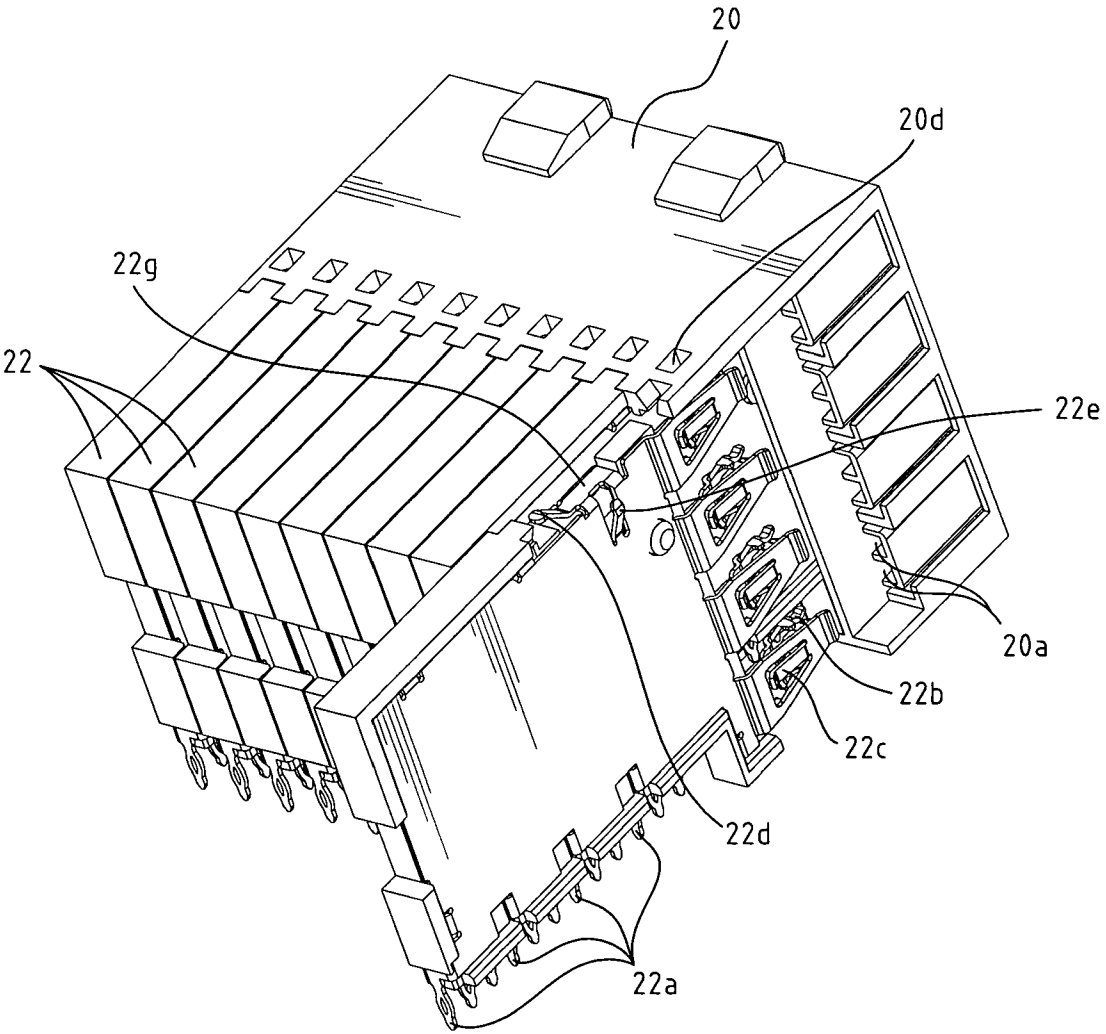
FIG. 3D is a perspective view showing the female connector of FIG. 3C viewed from another angle.
Figure 3E:
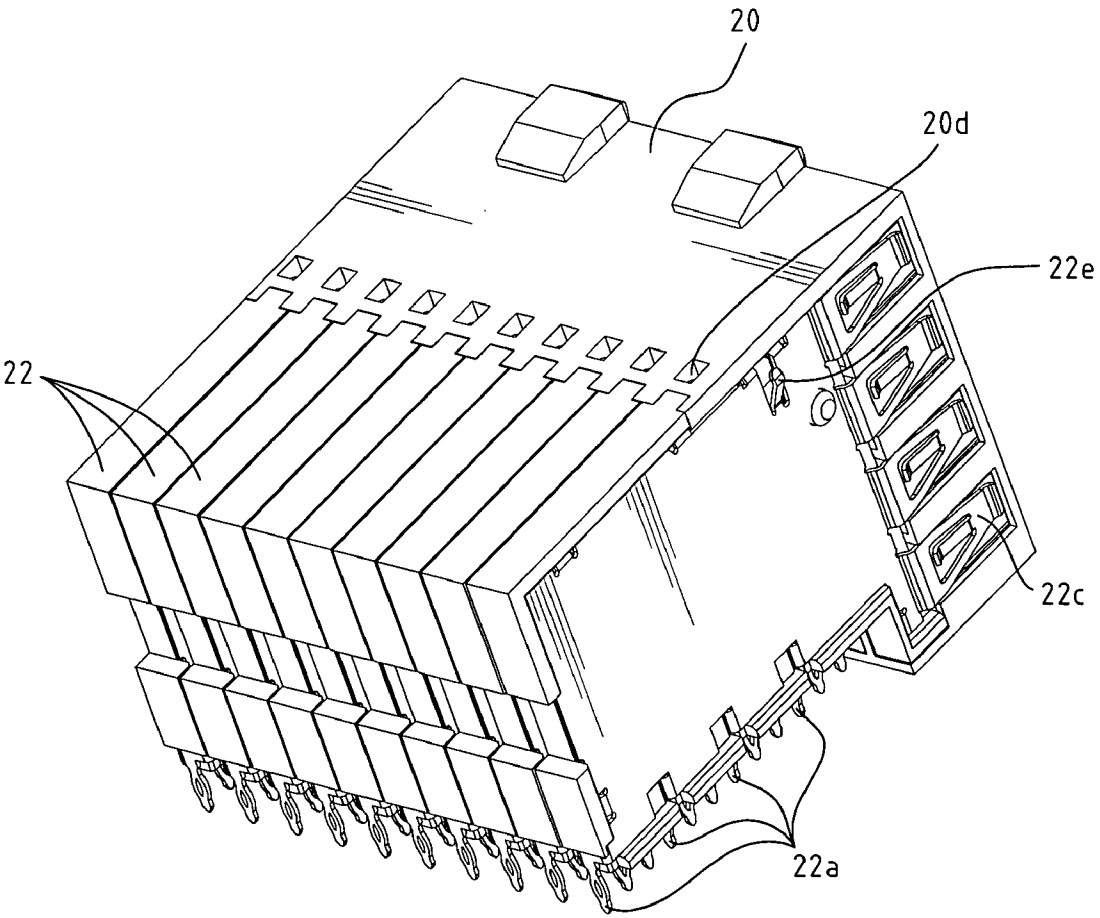
FIG. 3E is a perspective view showing the female connector of FIG. 3A viewed from another angle.
Figure 4:
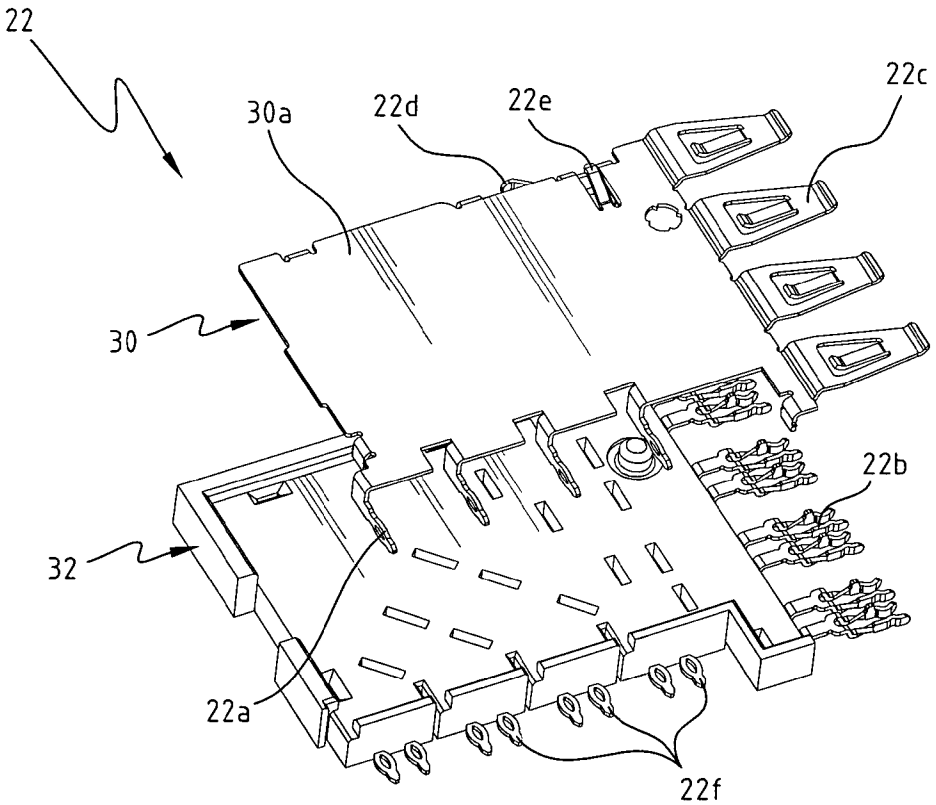
FIG. 4 is a perspective view showing the terminal module according to the present invention including a grounding member and a module base.

Referring to FIGS. 3A, 3D and 4, the grounding member 30 is substantially made of metal and includes a main body 30*a*, a plurality of the signal pins 22*c*, an extension portion 22*g*, an elastic fixing portion 22*d*, and a contact arm 22*e* corresponding to the extension portion 22*g*. The main body 30*a* is approximately a thin sheet. The signal pins 22*c* are disposed at a side of the main body 30*a*. The extension portion 22*g* is extended from an edge of the main body 30*a* and perpendicular to the main body 30*a*. The fixing portion 22*d* is extended from the extension portion 22*g* and in a direction parallel to the edge of the main body 30*a*. Moreover, the fixing portion 22*d* has a raised end. The contact arm 22*e* is extended from a side surface of the main body 30*a* and away from the extension portion 22*g*. The terminal base 32 is a case made of an insulating material and includes circuits, a plurality of signal pins 22*b* and signal ends 22*f*. The size of the terminal base 32 is corresponding to that of the grounding member 30. The connector insulator 20 includes a plurality of signal terminal openings 20*a*, U-shaped grounding terminal openings 20*b* and fixing openings 20*d*. Each of the grounding terminal openings 20*b* surrounds a pair of the signal terminal openings 20*a*. The size and location of the fixing openings 20*d* are corresponding to those the raised ends of the fixing portions 22*d* of the terminal modules 22.

FIGS. 3A to 3E show the female connector having the terminal modules 22 and the connector insulator 20 in various angles, and therefore the configuration of the terminal modules 22 according to the present invention is clearly shown. FIG. 3B is a front view showing the female connector of FIG. 3A. FIG. 3C is a perspective view showing the female connector of FIG. 3B after the female connector is cut off along Line 3C-3C. FIG. 3D is a perspective view showing the female connector of FIG. 3C viewed from another angle Referring to FIG. 3D, when the terminal module 22 is fitted into the connector insulator 20, the raised end of the elastic fixing portion 22*d* is engaged with the fixing opening 20*d* of the connector insulator 20. Thus, the terminal module 22 is securely connected with the connector insulator 20.

Referring to FIGS. 3D and 4, the elastic fixing portion 22*d* is extended from the grounding member 30 (more specifically, from the extension portion 22*g*) and is made of metal. The strength of the fixing portion 22*d* is higher than that of a conventional fixing portion. Therefore, the fixing portion 22*d* overcomes the disadvantage of the conventional fixing portion that is easy to fracture.

Figure 5A:
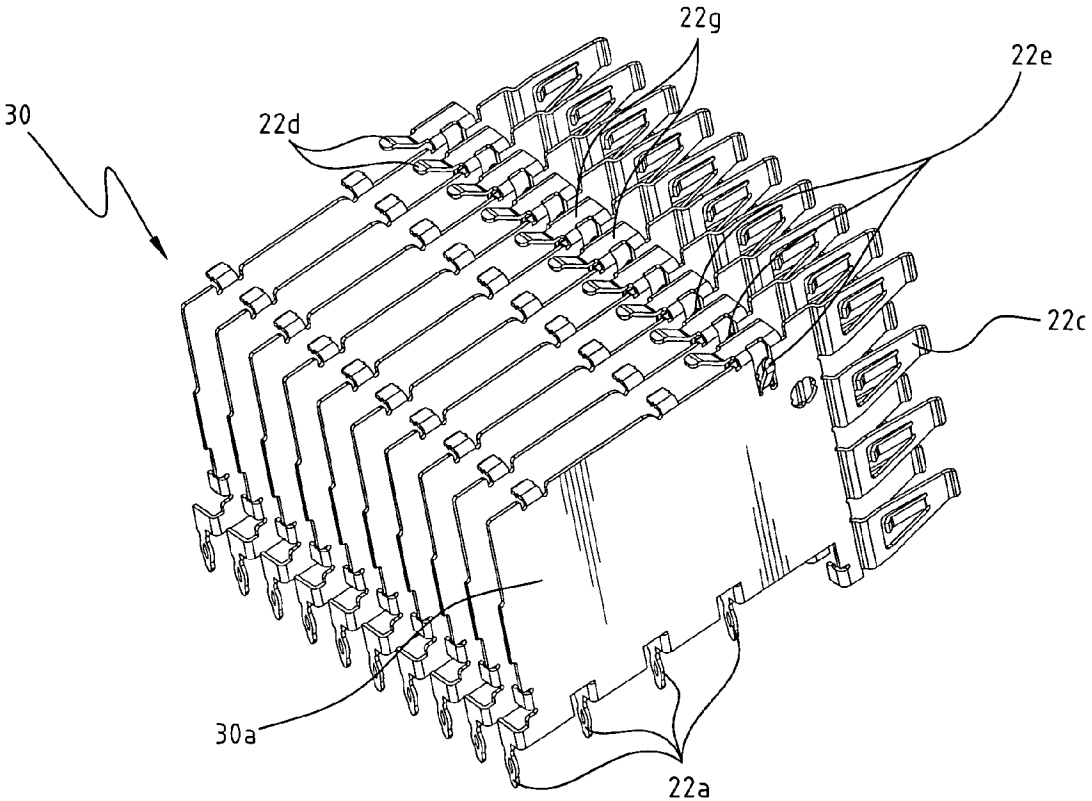
FIG. 5A is a perspective view showing the grounding members are connected in series.
Figure 5B:
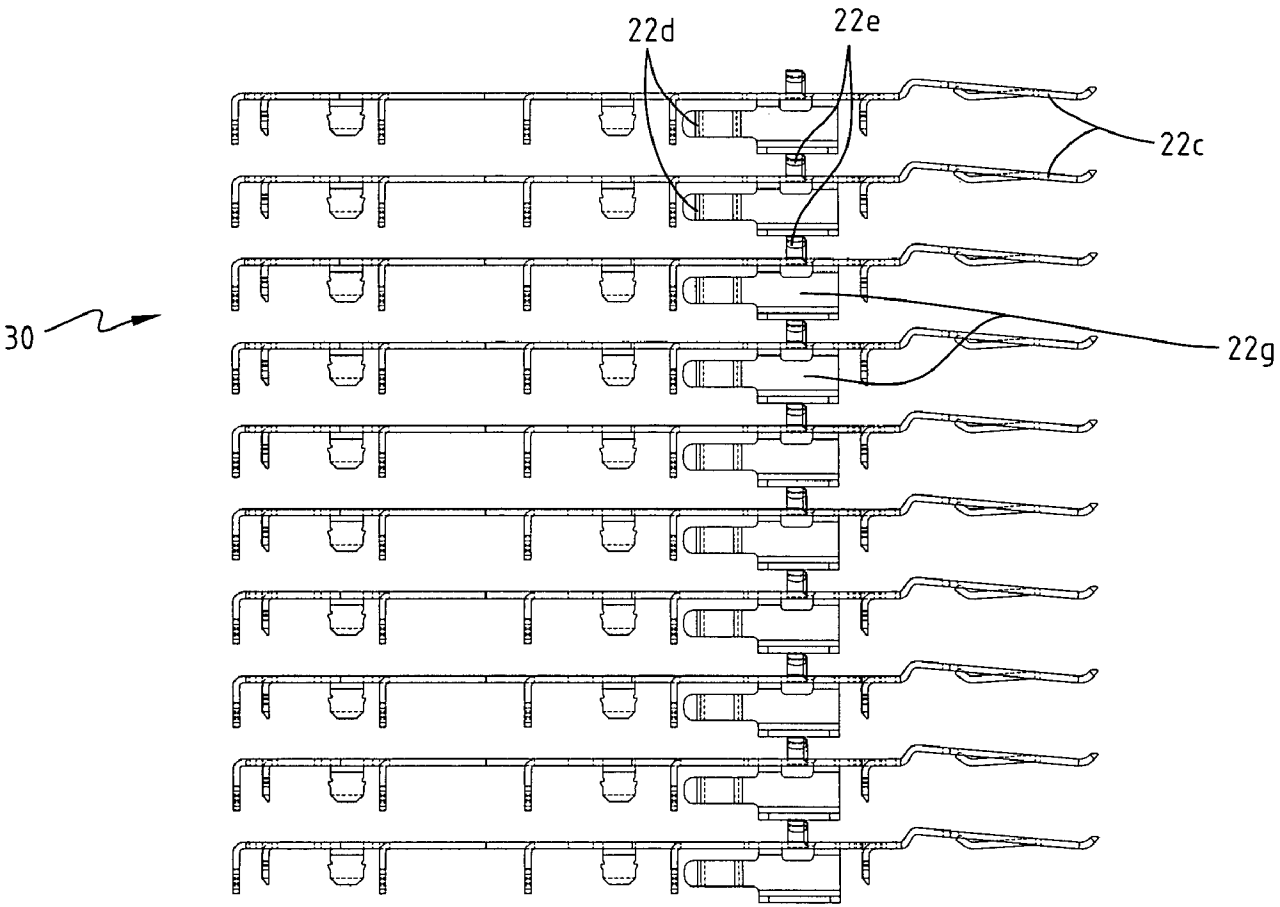
FIG. 5B is a top view showing the grounding members are connected in series.

FIGS. 5A and 5B show a plurality of the terminal modules 22 fitted into the connector insulator 20, but the module bases 32 of the terminal modules 22 and the connector insulator 20 are removed for a clear view of the grounding members 30 connected in series. When the terminal modules 22 are fitted into the connector insulator 20, the extension portion 22*g* of the terminal module 22 is contacted with and electrically connected with a contact arm 22*e* of an adjacent terminal module 22. Therefore, the grounding members 30 of the terminal modules 22 are electrically connected in series. Thus, in addition to the grounding ends 22*a* that remove the electromagnetic interference, the grounding members 30 which are electrically connected in series improve the grounding effect of the terminal modules 22.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A terminal module capable of being engaged with a connector insulator of a female connector, the connector insulator comprising a plurality of fixing openings, the terminal module comprising:

an insulating module base having circuits and a plurality of signal pins at a side thereof; and a sheet-like grounding member corresponding to the module base substantially made of metal and comprising:

an extension portion extended from an edge of the grounding member and perpendicular to the grounding member; and a contact arm corresponding to the extension portion, extended from a side surface of the grounding member and away from the extension portion;

wherein the extension portion of the terminal module is contacted with and electrically connected with a contact arm of an adjacent terminal module when a plurality of the terminal modules is fitted into the connector insulator.

2. The terminal module as claimed in claim 1, wherein an elastic fixing portion having a raised end is extended from the extension portion and in a direction parallel to the edge of the grounding member; a size of the raised end of the fixing portion is corresponding to that of the fixing opening of the connector insulator.

3. The terminal module as claimed in claim 2, wherein the raised ends of the fixing portions are engaged with the fixing openings of the connector insulator when the terminal modules are fitted into the connector insulator.

* * * * *